US006810857B2

(12) United States Patent
Boehland et al.

(10) Patent No.: US 6,810,857 B2
(45) Date of Patent: Nov. 2, 2004

(54) FUEL INJECTION SYSTEM FOR AN INTERNAL COMBUSTION ENGINE

(75) Inventors: Peter Boehland, Marbach (DE); Godehard Nentwig, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/437,118

(22) Filed: May 14, 2003

(65) Prior Publication Data

US 2004/0011882 A1 Jan. 22, 2004

(30) Foreign Application Priority Data

May 14, 2002 (DE) ..... 102 21 384

(51) Int. Cl.[7] ..... F02M 55/00
(52) U.S. Cl. ..... 123/467; 239/96; 123/299
(58) Field of Search ..... 123/467, 299–300; 239/88–96

(56) References Cited

U.S. PATENT DOCUMENTS 4,627,571 A * 12/1986 Kato et al. ..... 239/90
6,405,941 B2 * 6/2002 Ganser ..... 239/88
6,499,669 B2 * 12/2002 Ganser ..... 239/96
6,637,670 B2 * 10/2003 Rodriguez-Amaya et al. ... 239/88
6,712,296 B1 * 3/2004 Hlousek et al. ..... 239/533.3

* cited by examiner

*Primary Examiner*—Thomas Moulis
(74) *Attorney, Agent, or Firm*—Ronald E. Greigg

(57) ABSTRACT

The fuel injection system has one high-pressure fuel pump and one fuel injection valve, communicating with it, for each cylinder of the engine. The fuel pump piston is driven in by the engine and defines a pump work chamber communicating with a pressure chamber of the fuel injection valve. The fuel injection valve has a first hollow injection valve member movable in an opening direction counter to a closing force by the pressure prevailing in the pressure chamber to control at least one first injection opening. A second injection valve member is guided displaceably inside the first injection valve member and is movable counter to a closing force in an opening direction by the pressure prevailing in the pressure chamber member to control at least one second injection opening. One face is associated respectively with the first injection valve member and the second injection valve member and is acted upon by the pressure prevailing in a fuel-filled pressure chamber.

20 Claims, 3 Drawing Sheets

FUEL INJECTION SYSTEM FOR AN INTERNAL COMBUSTION ENGINE

BACKGROUND OF THE INVENTION

1. Field of the Invention

The invention is directed to an improved fuel injection system for an internal combustion engine.

2. Description of the Prior Art

One fuel injection system known from European Patent Disclosure EP 0 957 261 A1 has one high-pressure fuel pump and one fuel injection valve, communicating with it, for each cylinder of the engine. The high-pressure fuel pump has a pump piston, which is driven in a reciprocating motion by the engine and defines a pump work chamber that communicates with a pressure chamber of the fuel injection valve. The fuel injection valve has an injection valve member, by which at least one injection opening is controlled and which is movable in an opening direction, counter to a closing force, by the pressure prevailing in the pressure chamber. By means of a first electrically controlled control valve, a communication of the pump work chamber with a relief chamber is controlled in order to control the fuel injection. A face acted upon by the pressure prevailing in a fuel-filled pressure chamber is associated with the injection valve member, and by way of it, by means of the pressure prevailing in the control pressure chamber, a force in the closing direction is generated on the injection valve member. The control pressure chamber has a communication with the pump work chamber and a communication, controlled by a second electrically actuated control valve, with a relief chamber. If the force on the injection valve member in the opening direction generated by the pressure in the pump work chamber and thus in the pressure chamber of the fuel injection valve is greater than the force generated by the pressure prevailing in the control pressure chamber and the closing force on the injection valve member, the injection valve member moves in the opening direction and uncovers the at least one injection opening. The injection cross section which is controlled by the injection valve member is always of equal size. This does not make optimal fuel injection possible under all engine operating conditions.

OBJECT AND SUMMARY OF THE INVENTION

The fuel injection system of the invention has the advantage over the prior art that by means of the second injection valve member with the at least one second injection opening, an increased injection cross section can be opened or closed, so that the injection cross section can be adapted optimally to the operating conditions of the engine. Controlling the injection cross section is done in a simple way by the pressure in the control pressure chamber that is controlled by means of the second electrically actuated control valve.

Advantageous embodiments and refinements of the fuel injection system of the invention are disclosed. One embodiment makes a staggered opening of the second injection valve member possible relative to the first injection valve member. Another embodiment makes an optimal preinjection of a slight fuel quantity possible, while another embodiment makes it possible for the first injection valve member, beginning at a position that is opened with a maximum opening stroke, no longer to be closable by the pressure prevailing in the control pressure chamber, so that the opening of the second injection valve member can be controlled independently by the pressure prevailing in the control pressure chamber. A further embodiment makes an optimal main injection possible if only a relatively slight fuel quantity is to be injected in such a main injection, while another embodiment makes an optimal main injection possible if a relatively large fuel quantity is to be injected in such a main injection.

BRIEF DESCRIPTION OF THE DRAWINGS

The invention will be better understood and further objects and advantages thereof will become more apparent from the ensuing detailed description of a preferred embodiment taken in conjunction with the drawings, in which.

DESCRIPTION OF THE PREFERRED EMBODIMENTS

Figure 1:
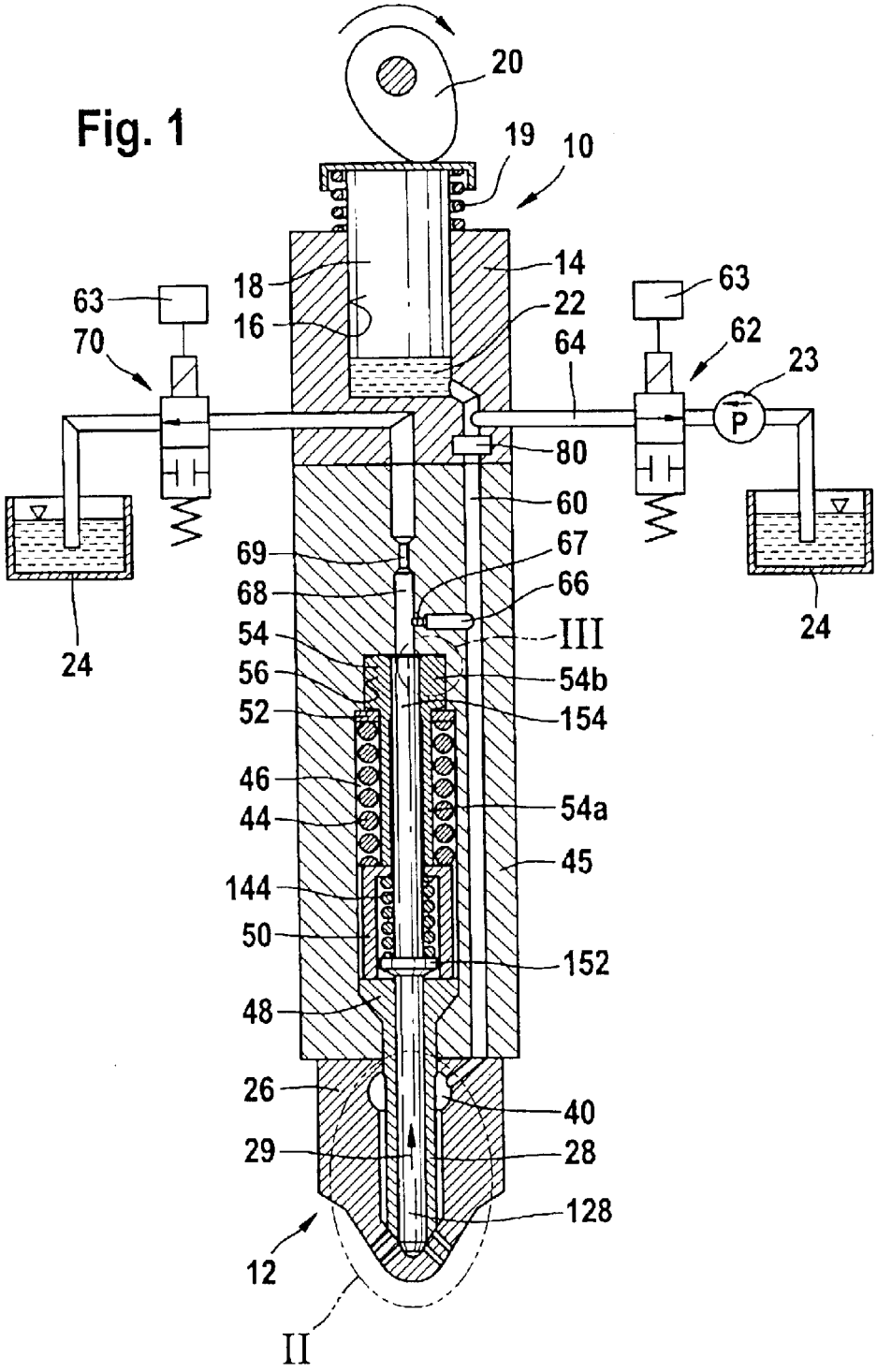
FIG. 1 shows a fuel injection system for an internal combustion engine in a schematic longitudinal section.

In FIGS. 1–4, a fuel injection system for an internal combustion engine of a motor vehicle is shown. The engine is preferably a self-igniting engine. The fuel injection system is embodied as a unit fuel injector or as a pump-line-nozzle system, and for each cylinder of the engine it has one high-pressure fuel pump 10 and one fuel injection valve 12 communicating with it. In an embodiment as a pump-line-nozzle system, the high-pressure fuel pump 10 is disposed at a distance from the fuel injection valve 12 and communicates with it via a line. In the exemplary embodiment shown, the fuel injection system is embodied as a unit fuel injector, in which the high-pressure fuel pump 10 and the fuel injection valve 12 communicate directly with one another and form a structural unit. The high-pressure fuel pump 10 has a pump piston 18, guided tightly in a pump body 14 in a cylinder bore 16, and this piston is driven in a reciprocating motion by a cam 20 of a camshaft of the engine, counter to the force of a restoring spring 19. In the cylinder 16, the pump piston 18 defines a pump work chamber 22, in which fuel is compressed under high pressure in the pumping stroke of the pump piston 18. In the intake stroke of the pump piston, in a manner not shown in detail, fuel from a fuel tank 24 of the motor vehicle is delivered to the pump work chamber 22.

Figure 2:
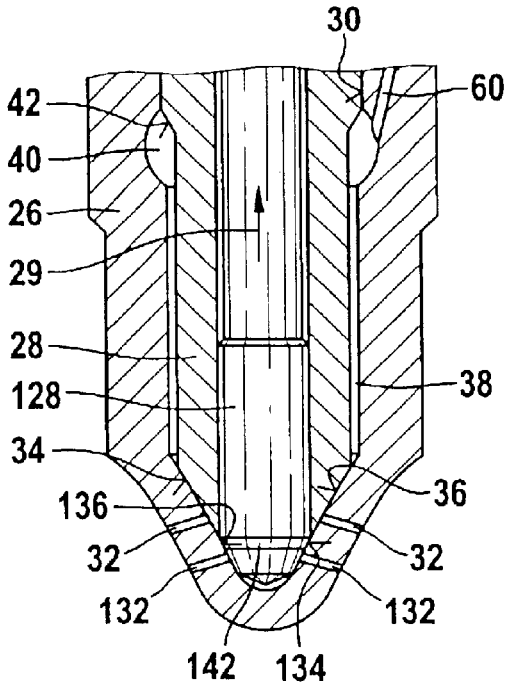
FIG. 2 shows an enlarged detail of the fuel injection system, marked II in FIG. 1.

The fuel injection valve 12 has a valve body 26, which can be embodied in multiple parts, and in which a first injection valve member 28 is guided longitudinally displaceably in a bore 30. As shown in FIG. 2, the valve body 26, in its end region toward the combustion chamber of the cylinder of the engine, has at least one first and preferably a plurality of first injection openings 32, which are distributed over the circumference of the of the valve body 26. The injection valve member 28, in its end region toward the combustion chamber, has a sealing face 34, which for instance is approximately conical and which cooperates with a valve seat 36, embodied in the end region of the valve body 26 toward the combustion chamber, from which seat or downstream of which the first injection openings 32 lead away. An annular chamber 38 is located in the valve body 26, between the injection valve member 28 and the bore 30, toward the valve seat 36; in its end region remote from the valve seat 36, this annular chamber changes over, as a result of a radial enlargement of the bore 30, into a pressure chamber 40 surrounding the first injection valve member 28. The first injection valve member 28 has a pressure shoulder 42 at the level of the pressure chamber 40, as a result of a cross-sectional reduction. A first prestressed closing spring 44 engages the end of the first injection valve member 28 remote from the combustion chamber and presses the first injection valve member 28 toward the valve seat 36. The first closing spring 44 is disposed in a spring chamber 46, which adjoins the bore 30 and is formed in the valve body 26 or in the pump body 14, or in an intermediate body 45 disposed between the valve body 26 and the pump body 14.

The first injection valve member 28 of the fuel injection valve 12 is embodied as hollow, as shown in FIGS. 1 and 2, and a second injection valve member 128 is guided displaceably in it, in a bore embodied coaxially in the injection valve member 28. By means of the second injection valve member 128, at least one second injection opening 132 in the valve body 26 is controlled. Toward the combustion chamber, the at least one injection opening 132 is offset from the at least one first injection opening 32 in the direction of the longitudinal axis of the injection valve members 28, 128. The second injection valve member 128, in its end region toward the combustion chamber, has a sealing face 134, which for instance is approximately conical, and which cooperates with a valve seat 136, embodied in the end region toward the combustion chamber of the valve body 26, from which or downstream of which seat the second injection openings 132 lead away. A pressure face 142, on which the pressure prevailing in the pressure chamber 40 is exerted when the first injection valve member 28 is open, is formed on the second injection valve member 128, near its end toward the combustion chamber.

The first injection valve member 28 is adjoined, as shown in FIG. 1, by a support sleeve 48, on whose side pointing away from the injection valve member 28 a cup-shaped sleeve 50 is braced, on whose side remote from the support sleeve 48 the first closing spring 44 is braced in turn. The first closing spring 44 is braced on the other end on a spring plate 52 placed in the spring chamber 46. A first control piston 54, which is embodied with a graduated diameter, is also braced on the side of the sleeve 50 remote from the support sleeve 48. The first control piston 54 is disposed with a smaller-diameter portion 54*a* in the spring chamber 46 and protrudes with a larger-diameter portion 54*b* into a bore 56 adjoining the spring chamber 46. The first control piston 54 passes through the spring plate 52 with its portion 54*a*. The first control piston 54 is embodied as hollow, and its portion 54*b* is guided tightly in the bore 56 and in it, with its annular end face 55, partly defines a control pressure chamber 58.

A second control piston 154 is braced on the side of the second injection valve member 128 remote from the combustion chamber; it protrudes through the support sleeve 48, the sleeve 50, and the first control piston 54 on into the bore 56, where with its end face 155 it likewise defines part of the control pressure chamber 58. The second control piston 154 is tightly guided in its end region in the portion 54*b* of the first control piston 54. The second control piston 154, in its region disposed in the sleeve 50, has an increased-diameter collar 152, and a second closing spring 144 is fastened between this collar and the bottom, remote from the support sleeve 48, of the sleeve 50. By means of the second closing spring 144, the second injection valve member 128 is urged in the closing direction via the second control piston 154.

A conduit 60 leads from the pump work chamber 22 through the pump body 14, the intermediate body 45, and the valve body 26 into the pressure chamber 40 of the fuel injection valve 12. By means of a first electrically actuated control valve 62, a communication 64 of the pump work chamber 22 with a relief chamber, as which the fuel tank 24 or the compression side of a feed pump 23 can for instance serve at least indirectly, and through this communication, fuel from the fuel tank 24 is pumped into the pump work chamber 22. As long as no fuel injection is intended to occur, the communication 64 of the pump work chamber 22 with the relief chamber is opened by the control valve 62, so that high pressure cannot build up in the pump work chamber 22. When a fuel injection is to occur, the pump work chamber 22 is disconnected from the relief chamber by the control valve 62, so that in the pumping stroke of the pump piston 18, high pressure can build up in the pump work chamber 22. The control valve 62 can have an electromagnetic actuator or a piezoelectric actuator. By way of example, the control valve 62 is embodied as a 2/2-way valve and can be switched back and forth between an open and a closed switching position, and is triggered by an electronic control unit 63.

The control pressure chamber 58 has a communication with the conduit 60 and thus with the pump work chamber 22 via a bore 66. A throttle restriction 67 is disposed in the bore 66. The control pressure chamber 58 furthermore has a communication, via a bore 68, with a relief chamber, as which the fuel tank 24 serves at least indirectly. A throttle restriction 69 is disposed in the bore 68. The throttle restrictions 67 and 69 are adapted to one another in their dimensioning, to enable purposeful filling of the control pressure chamber 58 with fuel from the pump work chamber 22 and relief of the control pressure chamber 58 to the relief chamber 24. The communication of the control pressure chamber 58 with the relief chamber 24 is controlled by a second electrically actuated control valve 70, which can be embodied like the first control valve 62 and is triggered by the control unit 63.

Figure 3:
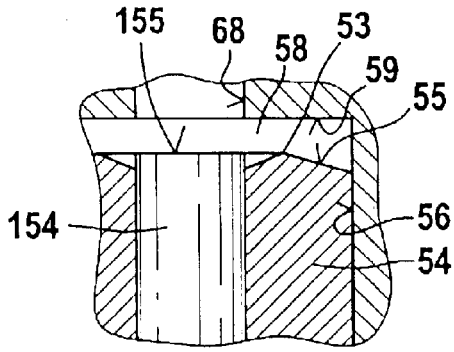
FIG. 3 shows an enlarged detail of the fuel injection system, marked III in FIG. 1, with the injection valve members closed.
Figure 4:
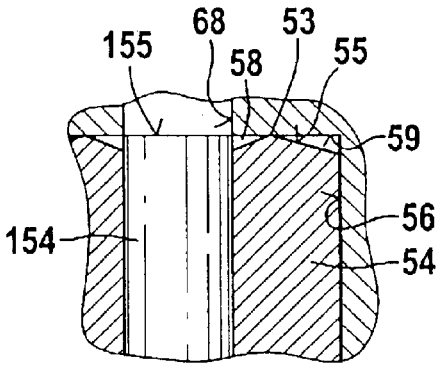
FIG. 4 shows the detail III with the injection valve members open.

The bore 68, by way of which the control pressure chamber 58 has the communication with the relief chamber 24, is embodied with a smaller diameter than the bore 56, in which the control pressure chamber 58 is formed, so that an annular boundary 59 of the control pressure chamber 58 is formed at the transition from the control pressure chamber 58 to the bore 68. The first control piston 54, as shown in FIGS. 3 and 4, at its end face 55 oriented toward the boundary 59, has an annular protuberance 53, which compared to the end face 55 has a lesser width in the radial direction of the control piston 54. The protuberance 53 can for instance be formed by embodying the end of the first control piston 54 with contrary chamfers, as shown in FIGS. 3 and 4. When the first injection valve member 28 executes a stroke in the opening direction 29, the first control piston 54 is likewise moved in the direction of the arrow 29, via the support sleeve 48 and the sleeve 50. The maximum opening stroke of the first injection valve member 28 is limited by the provision that the first control piston 54, with its protuberance 53, comes into contact with the boundary 59 of the control pressure chamber 58. In FIG. 3, the control pistons 54, 154 are shown in their position where the injection valve members 28, 128 are disposed in their closing position, and in FIG. 4, the control pistons 54, 154 are shown in their position where the injection valve members 28, 128 are in their open position with a maximum opening stroke. When the first control piston 54, as shown in FIG. 4, rests with its protuberance 53 on the boundary 59 of the control pressure chamber 58, only the portion of the end face 55 of the first control piston 54 located inside the protuberance 53 is acted on any longer by the pressure prevailing in the control pressure chamber 58, while the portion of the end face 55 of the first control piston 54 located outside the protuberance is disconnected from the control pressure chamber 58.

Both control valves 62 and 70 are triggered by the electronic control unit 63. Signals pertaining to engine operating parameters, such as rpm, load, and temperature, in particular, as well as such other parameters as the air temperature, air pressure, and optionally others, are delivered to the control unit 63. By means of the control unit 63, the control valves 62 and 70 are triggered as a function of these parameters in order to control the fuel injection.

The function of the fuel injection system will now be explained. In the intake stroke of the pump piston 18, the first control valve 62 is opened, so that fuel from the fuel tank 24 reaches the pump work chamber 22. At a certain instant in the supply stroke of the pump piston 18, the first control valve 62 is closed by the control unit 63, so that the pump work chamber 22 is disconnected from the relief chamber, and high pressure builds up in the pump work chamber 22. The second control valve 70 is initially kept closed by the control unit 63, so that at least approximately, high pressure as in the pump work chamber 22 builds up in the control pressure chamber 58 as well. Both injection valve members 28, 128 are kept in their closing position both by the closing springs 44, 144 acting on them and by the forces generated on them in the closing direction via the control pistons 54, 154 as a result of the pressure prevailing in the control pressure chamber 58, so that no fuel injection occurs.

For a preinjection of a slight fuel quantity, the second control valve 70 is opened by the control unit 63, so that the control pressure chamber 58 communicates with the relief chamber 24, and the pressure in the control pressure chamber 58 drops. When the pressure in the pump work chamber 22 and thus in the pressure chamber 40 of the fuel injection valve 12 is so high that the pressure force generated by it on the first injection valve member 28 via the pressure shoulder 42 is greater than the sum of the force of the first closing spring 44 and the force, generated by the residual pressure prevailing in the control pressure chamber 58, on the first injection valve member 28 via the first control piston 54, the fuel injection valve 12 opens; the first injection valve member 28 lifts with its sealing face 34 from the valve seat 36 and uncovers the at least one first injection opening 32. The pressure force generated on the second injection valve member 128 by the pressure prevailing in the pressure chamber 40 via the pressure shoulder 142 is less than the sum of the force generated on the second injection valve member 128 in the closing direction via the second control piston 154 by means of the residual pressure prevailing in the control pressure chamber 58, so that the second injection valve member 128 remains in its closing position. Thus at the fuel injection valve 12, when the first injection openings 32 are opened, only a portion of the total injection cross section is opened, so that correspondingly only a slight fuel quantity is injected. For terminating the preinjection, the second control valve 70 is closed by the control unit 63, so that the pressure in the control pressure chamber 58 rises again, and the first injection valve member 28, because of the greater force in the closing direction generated on it by the first control piston 54, is moved into its closing position again. The length of time for which the second control valve 70 is opened for the preinjection is very brief, so that the first injection valve member 28 opens with only a partial stroke, and the first control piston 54, with its protuberance 53, does not come into contact with the boundary 59 of the control pressure chamber 58. Thus the entire end face 55 of the first control piston 54 is acted upon by the pressure prevailing in the control pressure chamber 58, and with the second control valve 70 closed, the rising pressure prevailing in the control pressure chamber 58 generates a force on the first control piston 54 that suffices to move the first injection valve member 28 into its closing position, counter to the pressure prevailing in the pressure chamber 40. When the first injection valve member 28 is opened with only a partial stroke, then between its sealing face 34 and the valve 36, only a narrow gap is furthermore created, in which throttling of the fuel flowing through it occurs, so that the force acting in the opening direction 29 on the injection valve member 28 is less than when the injection valve member 28 is open with a maximum opening stroke.

After the termination of the preinjection, the first control valve 62 is preferably kept closed, so that a further pressure buildup occurs in the pump work chamber 22. For a main injection of a greater fuel quantity than in the preinjection, the second control valve 70 is opened at a defined instant by the control unit 63, so that the control pressure chamber 58 communicates with the relief chamber 24, and the pressure in the control pressure chamber 58 drops. The first injection valve member 28 then opens and uncovers the at least one first injection opening 32. The first injection valve member 28 opens with its maximum opening stroke in this situation, so that the first control piston 54, with its protuberance 53, comes into contact with the boundary 59 of the control pressure chamber 58. If only a relatively slight fuel quantity is to be injected, then directly afterward the second control valve 70 is closed again by the control unit 63, so that the pressure in the control pressure chamber 58 rises again, before the second injection valve member 128 is moved in the opening direction 29 by the pressure prevailing in the pressure chamber 40. The second injection valve member 128 is then kept in its closing position by the high pressure exerted on the second control piston 154. The first injection valve member 28 remains in its position that is open with the maximum opening stroke, since only the portion of the end face 55 of the first control piston 54 that is located inside the protuberance 53 is acted upon by the pressure prevailing in the control pressure chamber 58, thus resulting only in a force in the closing direction on the first control piston 54 and thus on the first injection valve member 28, which force is less than the force generated in the opening direction 29 by the pressure prevailing in the pressure chamber 40. For terminating the main injection, the first control valve 62 is then opened by the control unit 63, so that the pressure in the pressure chamber 40 drops, and the first injection valve member 28 closes as a result of the force of the first closing spring 44 and the pressure generated on the first control piston 54 by the pressure prevailing in the control pressure chamber 58.

If a relatively large fuel quantity is to be injected in the main injection, then the second control valve 70 is kept open longer by the control unit 63, so that the second injection valve member 128 as well opens as a result of the pressure prevailing in the pressure chamber 40, counter to the force of the second closing spring 144 and the force generated via the second control piston 154 by the residual pressure prevailing in the control pressure chamber 58, and uncovers the at least one second injection opening 132. The second injection valve member 128 opens with a delay after the first injection valve member 28, so that at the onset of the main injection, only the first injection valve member 28 is open.

Once the second injection valve member 128 has been opened as well, the entire injection cross section is open at the fuel injection valve 12, and a larger fuel quantity is injected. For terminating the main injection, the first control valve 62 is opened by the control unit 63, so that the pressure in the pressure chamber 40 drops, and the first and second injection valve members 28, 128 close as a result of the closing forces, acting on them, of the closing springs 44, 144 and the control pistons 54, 154. The second control valve 70 is closed by the control unit 73.

It can be provided that the injection cross sections, formed by the first injection openings 32 and second injection openings 132, are at least approximately of equal size, so that when only the first injection valve member 28 is opened, half of the total injection cross section is uncovered. Alternatively, it can be provided that the first injection openings 32 form a larger or smaller injection cross section than the second injection openings 132.

Figure 5:
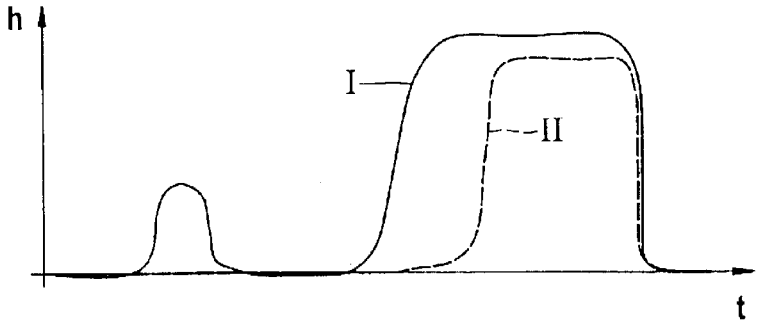
FIG. 5 shows stroke courses of injection valve members of the fuel injection system over time during one injection cycle.

In FIG. 5, the course of the opening stroke h is shown by a solid line for the first injection valve member 28 and by a dashed line for the second injection valve member 128, over the time t during one injection cycle. I indicates the preinjection and II designates the main injection. In the preinjection I, as explained above, only the first injection valve member 28 opens. In the main injection II, either only the first injection valve member 28 or, after a delay, the second injection valve member 128 as well opens. The delay upon opening of the second injection valve member 128 can be varied by means of the second control valve 70, by its being closed again after the opening of the first injection valve member 28 with a maximum opening stroke, so that because of the high pressure in the control pressure chamber 58, the second injection valve member 128 initially remains closed and is then opened again after a delay.

It can be provided that under certain engine operating parameters, especially at low load and/or rpm, when only a slight fuel quantity is injected, only the first injection valve member 28 opens during the entire pumping stroke of the pump piston 18, during both the preinjection and the main injection, while the second injection valve member 128 remains closed. At high engine load and/or rpm, when a larger fuel quantity is injected, it can be provided that only the first injection valve member 28 opens during the preinjection, while the second injection valve member 128 opens as well during the main injection.

A blocking valve 80 can be disposed in the conduit 60 in the communication between the pump work chamber 22 and the pressure chamber 40. The blocking valve 80 is disposed between the communication 64 of the pump work chamber 22 with the relief chamber 24 and the communication 66 of the control pressure chamber 58 with the conduit 60. The blocking valve 80 can be embodied as either a check valve that opens toward the pressure chamber 40 or an electrically actuated valve that is triggered by the control unit 63. By means of the blocking valve 80, the pressure chamber 40 and the control pressure chamber 58 can be disconnected from the pump work chamber 22. When the blocking valve 80 is closed, the pump work chamber 22, with the first control valve 62 open, can communicate with the relief chamber 24 and thus be relieved, while with the second control valve 70 closed, fuel under pressure can be stored in the pressure chamber 40 and in the control pressure chamber 58. By opening the second control valve 70, either a preinjection, or a postinjection of fuel after the main injection, can be effected without fuel having to be pumped by the pump piston 18 at the instant of the preinjection or postinjection.

The foregoing relates to a preferred exemplary embodiment of the invention, it being understood that other variants and embodiments thereof are possible within the spirit and scope of the invention, the latter being defined by the appended claims.

We claim:

1. In a fuel injection system for an internal combustion engine, having one high-pressure fuel pump (10) and one fuel injection valve, communicating with it, for each cylinder of the engine, wherein the high-pressure fuel pump (10) has a pump piston (18), that is driven by the engine in a reciprocating motion and that defines a pump work chamber (22), which communicates with a pressure chamber (40) of the fuel injection valve (12), and the fuel injection valve (12) has at least one first injection valve member (28), by which at least one first injection opening (32) is controlled and which is movable, subjected to the pressure prevailing in the pressure chamber (40), counter to a closing force in an opening direction (29), having a first electrically actuated control valve (62), by which a communication of the pump work chamber (22) with a relief chamber (24) is controlled, and associated with the at least one first injection valve member (28) is a face (55), which is acted upon by the pressure prevailing in a fuel-filled pressure chamber (58), by way of which face, by means of the pressure prevailing in the control pressure chamber (58), a force on the first injection valve member (28) in the closing direction is generated, and the control pressure chamber (58) has at least one communication (66), at least indirectly, with the pump work chamber (22) and one communication (68), controlled by a second electrically actuated control valve (70), with a relief chamber (24), the improvement wherein the first injection valve member (28) is hollow, wherein the fuel injection valve (12) has a second injection valve member (128), guided displaceably inside the hollow first injection valve member (28), by which second injection valve member at least one second injection opening (132) is controlled, and which is movable, acted upon by the pressure prevailing in the pressure chamber (40), counter to a closing force in an opening direction (29); and wherein a face (155) associated with the second injection valve member (128) is acted upon by the pressure prevailing in the control pressure chamber (58), by way of which face, by means of the pressure prevailing in the control pressure chamber (58), a force in the closing direction on the second injection valve member (128) is generated.

2. The fuel injection system of claim 1, wherein when the communication (68) of the control pressure chamber (58) with the relief chamber (24) has been opened by the second electrically actuated control valve (70), the first injection valve member (28) opens at a lesser pressure in the pressure chamber (40) than the second injection valve member (128).

3. The fuel injection system of claim 2, wherein for a preinjection of fuel with the first control valve (62) closed, the second control valve (70) is opened, so that the first injection valve member (28) opens with a partial stroke as a result of the pressure prevailing in the pressure chamber (40), while the second injection valve member (128) remains in its closing position; and wherein directly afterward, to terminate the preinjection, the second control valve (70) is closed again, so that the first injection valve member (28) closes as a result of the pressure prevailing in the control pressure chamber (58).

4. The fuel injection system of claim 1, further comprising stop means limiting the maximum opening stroke of the first injection valve member (28); and that when the first injection valve member (28) is open with the maximum opening stroke, the face (55) associated with it and acted upon by the pressure prevailing in the control pressure chamber (58) is smaller than when the first injection valve member (28) is in its closing position or is opened with only a partial stroke.

5. The fuel injection system of claim 2, further comprising stop means limiting the maximum opening stroke of the first injection valve member (28); and that when the first injection valve member (28) is open with the maximum opening stroke, the face (55) associated with it and acted upon by the pressure prevailing in the control pressure chamber (58) is smaller than when the first injection valve member (28) is in its closing position or is opened with only a partial stroke.

6. The fuel injection system of claim 3, further comprising stop means limiting the maximum opening stroke of the first injection valve member (28); and that when the first injection valve member (28) is open with the maximum opening stroke, the face (55) associated with it and acted upon by the pressure prevailing in the control pressure chamber (58) is smaller than when the first injection valve member (28) is in its closing position or is opened with only a partial stroke.

7. The fuel injection system of claim 4, wherein for a main injection of fuel, with the first control valve (62) closed, the second control valve is opened, so that the first injection valve member (28) opens with a maximum opening stroke as a result of the pressure prevailing in the pressure chamber (40); and wherein directly afterward the second control valve (70) is closed, so that the second injection valve member (128) remains in its closing position while the force in the closing direction on the first injection valve member (28) generated by the pressure prevailing in the control pressure chamber (58) is so slight, because of the reduced-size face (55), that the first injection valve member (28) remains in its position that is open with a maximum opening stroke.

8. The fuel injection system of claim 1, wherein for a main injection of fuel, with the first control valve (62) closed, the second control valve is opened, so that the first injection valve member (28) opens with a maximum opening stroke as a result of the pressure prevailing in the pressure chamber (40); and wherein with increasing pressure in the pressure chamber (40), the second injection valve member (128) likewise opens, later than the first injection valve member (28).

9. The fuel injection system of claim 2, wherein for a main injection of fuel, with the first control valve (62) closed, the second control valve is opened, so that the first injection valve member (28) opens with a maximum opening stroke as a result of the pressure prevailing in the pressure chamber (40); and wherein with increasing pressure in the pressure chamber (40), the second injection valve member (128) likewise opens, later than the first injection valve member (28).

10. The fuel injection system of claim 3, wherein for a main injection of fuel, with the first control valve (62) closed, the second control valve is opened, so that the first injection valve member (28) opens with a maximum opening stroke as a result of the pressure prevailing in the pressure chamber (40); and wherein with increasing pressure in the pressure chamber (40), the second injection valve member (128) likewise opens, later than the first injection valve member (28).

11. The fuel injection system of claim 4, wherein for a main injection of fuel, with the first control valve (62) closed, the second control valve is opened, so that the first injection valve member (28) opens with a maximum opening stroke as a result of the pressure prevailing in the pressure chamber (40); and wherein with increasing pressure in the pressure chamber (40), the second injection valve member (128) likewise opens, later than the first injection valve member (28).

12. The fuel injection system of claim 5, wherein to terminate the main injection, the first control valve (62) is opened and the second control valve (70) is closed.

13. The fuel injection system of claim 8, wherein to terminate the main injection, the first control valve (62) is opened and the second control valve (70) is closed.

14. The fuel injection system of claim 1, wherein the face (55) associated with the first injection valve member (28) and/or the face (155) associated with the second injection valve member (128) is disposed on a control piston (54; 154) which defines the control pressure chamber (58) and which is braced at least indirectly on the first injection valve member (28) and the second injection valve member (128), respectively.

15. The fuel injection system of claim 2, wherein the face (55) associated with the first injection valve member (28) and/or the face (155) associated with the second injection valve member (128) is disposed on a control piston (54; 154) which defines the control pressure chamber (58) and which is braced at least indirectly on the first injection valve member (28) and the second injection valve member (128), respectively.

16. The fuel injection system of claim 3, wherein the face (55) associated with the first injection valve member (28) and/or the face (155) associated with the second injection valve member (128) is disposed on a control piston (54; 154) which defines the control pressure chamber (58) and which is braced at least indirectly on the first injection valve member (28) and the second injection valve member (128), respectively.

17. The fuel injection system of claim 1, further comprising a throttle restriction (67) disposed in the communication (66) of the control pressure chamber (58) at least indirectly with the pump work chamber (22), and/or a throttle restriction (69) disposed in the communication (68) of the control pressure chamber (58) with the relief chamber (24).

18. The fuel injection system of claim 2, further comprising a throttle restriction (67) disposed in the communication (66) of the control pressure chamber (58) at least indirectly with the pump work chamber (22), and/or a throttle restriction (69) disposed in the communication (68) of the control pressure chamber (58) with the relief chamber (24).

19. The fuel injection system of claim 1, further comprising a blocking valve (80) disposed in the communication (60) of the pressure chamber (40) with the pump work chamber (22), by which blocking valve the pressure chamber (40) and the control pressure chamber (58) can be disconnected from the pump work chamber (22), the blocking valve (80) being located between the communication (64) with the relief chamber (24) that is controlled by the first control valve (62) and the communication (66) of the control pressure chamber (58) with the pump work chamber (22).

20. The fuel injection system of claim 2, further comprising a blocking valve (80) disposed in the communication (60) of the pressure chamber (40) with the pump work chamber (22), by which blocking valve the pressure chamber (40) and the control pressure chamber (58) can be disconnected from the pump work chamber (22), the blocking valve (80) being located between the communication (64) with the relief chamber (24) that is controlled by the first control valve (62) and the communication (66) of the control pressure chamber (58) with the pump work chamber (22).

* * * * *